US010893764B2

(12) United States Patent
Kang

(10) Patent No.: US 10,893,764 B2
(45) Date of Patent: Jan. 19, 2021

(54) PAPER CUP PROVIDED WITH HEAT CONDUCTION PREVENTION PLATE

(71) Applicant: Kyung Wook Kang, Pocheon-si (KR)

(72) Inventor: Kyung Wook Kang, Pocheon-si (KR)

( * ) Notice: Subject to any disclaimer, the term of this patent is extended or adjusted under 35 U.S.C. 154(b) by 0 days.

(21) Appl. No.: 16/485,658

(22) PCT Filed: Feb. 14, 2018

(86) PCT No.: PCT/KR2018/001941
§ 371 (c)(1),
(2) Date: Aug. 13, 2019

(87) PCT Pub. No.: WO2018/155863
PCT Pub. Date: Aug. 30, 2018

(65) Prior Publication Data

US 2019/0357710 A1 Nov. 28, 2019

(30) Foreign Application Priority Data

Feb. 21, 2017 (KR) ..... 10-2017-0022893
Apr. 5, 2017 (KR) ..... 10-2017-0044098

(51) Int. Cl.
*A47G 19/22* (2006.01)
*B65D 3/28* (2006.01)
(Continued)

(52) U.S. Cl.
CPC ..... *A47G 19/2288* (2013.01); *A47G 19/2205* (2013.01); *B65D 3/28* (2013.01); *B65D 25/20* (2013.01); *B65D 85/72* (2013.01)

(58) Field of Classification Search
CPC ..... B65D 3/28; B65D 25/20; B65D 85/72; B65D 3/06; B65D 81/3865; A47G 19/2288; A47G 19/2205
(Continued)

(56) References Cited

U.S. PATENT DOCUMENTS 5,667,135 A * 9/1997 Schaefer ..... A47G 23/0216 220/738
6,557,751 B2 * 5/2003 Puerini ..... A47G 23/0216 220/738
(Continued)

FOREIGN PATENT DOCUMENTS

KR 10-2003-0024332 A 3/2003
KR 10-0437508 B1 6/2004
(Continued)

OTHER PUBLICATIONS

KR Office Action dated May 16, 2017 as received in Application No. 10-2017-0022893.
(Continued)

*Primary Examiner* — Christopher R Demeree
(74) *Attorney, Agent, or Firm* — Maschoff Brennan

(57) ABSTRACT

The present invention relates to a paper cup provided with a heat conduction prevention plate. The paper cup is provided integrally with a heat conduction prevention plate by being attached to the paper cup, and thus it is not necessary for a user to frequently insert a separate heat conduction prevention plate into the paper cup when drinking a drink. Also, a certain space is formed between the integrated heat conduction prevention plate and the paper cup body, thereby effectively performing a heat conduction blocking function. Moreover, since the heat conduction prevention plate is provided in an area that can be held by a finger, it is possible to be manufactured at a low manufacturing cost, and the paper cup widens toward the top, so that the paper cup slips less from fingers.

3 Claims, 4 Drawing Sheets

(51) Int. Cl.
*B65D 25/20* (2006.01)
*B65D 85/72* (2006.01)

(58) Field of Classification Search
USPC ..... 229/400, 402, 403; 220/738, 592.17, 220/592.25
See application file for complete search history.

(56) References Cited

U.S. PATENT DOCUMENTS

| | | | | |
|---|---|---|---|---|
| 7,992,766 | B2 * | 8/2011 | Seo | B65D 25/2844 229/117.22 |
| 8,479,974 | B2 * | 7/2013 | Seo | B65D 81/3874 220/592.17 |
| 8,844,799 | B2 * | 9/2014 | Robertson | B65D 81/3886 220/592.2 |
| 8,870,054 | B2 * | 10/2014 | Zhou | B65D 21/08 229/101 |
| 9,056,712 | B2 * | 6/2015 | Cook | B31B 50/74 |
| 9,456,709 | B2 * | 10/2016 | Gonzalez | B65D 81/3874 |
| 9,926,099 | B2 * | 3/2018 | Kiefer | B65D 5/10 |

FOREIGN PATENT DOCUMENTS

| | | | |
|---|---|---|---|
| KR | 20-2008-0004515 | U | 10/2008 |
| KR | 10-2009-0057176 | A | 6/2009 |
| KR | 10-2010-0127331 | A | 12/2010 |
| KR | 10-1641534 | B1 | 7/2016 |

OTHER PUBLICATIONS

KR Office Action dated Jun. 14, 2017 as received in Application No. 10-2017-0044098.
KR Grant of Patent dated Aug. 15, 2017 as received in Application No. 10-2017-0022893.
KR Grant of Patent dated Jan. 19, 2018 as received in Application No. 10-2017-0044098.

* cited by examiner

PAPER CUP PROVIDED WITH HEAT CONDUCTION PREVENTION PLATE

TECHNICAL FIELD

The present invention relates to a paper cup provided with a heat conduction prevention plate. More particularly, the present invention relates to a paper cup integrally provided with a heat conduction prevention plate, so that it is not necessary for a user to frequently insert a separate heat conduction prevention plate into the paper cup when drinking a drink. In addition, a certain space is formed between the integrated heat conduction prevention plate and the paper cup body, thereby effectively performing a heat conduction blocking function. Further, the heat conduction prevention plate is provided to have an area that that can be held with fingers, thus being manufactured at a low manufacturing cost. Moreover, the width of the heat conduction prevention plate increases toward the top thereof, so that the heat conduction prevention plate slips less from fingers.

BACKGROUND ART

As well known, paper cups are widely used in beverage vending machines and coffee shops to accommodate beverages such as coffee and juice.

Existing paper cups are commonly constituted of a cylindrical cup body for accommodating beverages and a curled portion formed at the top of the cup body for protecting the lips of a user and increasing shape retention of the cup body.

However, such existing paper cups are commonly made of thin paper. Accordingly, when hot coffee or cold juice is accommodated therein, heat or chill thereof is transmitted to the user's hand, which makes it difficult for user to grip a paper cup.

Accordingly, in coffee shops that put hot coffee in a paper cup and sell the same, a paper cup containing hot coffee is inserted into an annular band-shaped holder (not shown) made of corrugated paper.

However, such a holder is generally inserted from the bottom of a paper cup, whereby the holder is frequently separated from the paper cup and falls onto a table when a user puts a paper cup on a table or a cup holder of an automobile for a while. Accordingly, when a user wants to grasp the paper cup again, there is an inconvenience that a user has to grip and lift up the cup holder, having fallen onto a table or a cup holder of an automobile, with two hands, and fits the same on a paper cup to grasp the paper cup.

In addition, since existing holders are made of corrugated paper, manufacturing cost thereof is high. Further, since existing paper cups are not grasped with the whole of palm, even parts not requiring heat conduction are insulated, which causing an increase in manufacturing cost.

In addition, coffee shops or beverage stores are provided with cup holders separately from paper cups and store the same separately. Further, when a beverage is provided to a customer, the customer should take a cup holder separately from a paper cup, which inconveniences the customer. In addition, retailers who should distribute or manage cup holders separately feel very inconvenient or cumbersome.

Moreover, since existing holders have a simple structure of closely contacting an outer circumference surface of a paper cup, they often slip from the hand and drop onto the floor together with a paper cup.

DISCLOSURE

Technical Problem

Therefore, the present invention has been made in view of the above problems, and it is one object of the present invention to provide a paper cup provided with a heat conduction prevention plate, more particularly a paper cup integrally provided with a heat conduction prevention plate, so that it is not necessary for a user to frequently insert a separate heat conduction prevention plate into the paper cup when drinking a drink. In addition, a certain space is formed between the integrated heat conduction prevention plate and the paper cup body, thereby effectively performing a heat conduction blocking function. Further, the heat conduction prevention plate is provided to have an area that that can be held with fingers, thus being manufactured at a low manufacturing cost. Moreover, the width of the heat conduction prevention plate increases toward the top thereof, so that the heat conduction prevention plate slips less from fingers.

Technical Solution

In accordance with an aspect of the present invention, the above and other objects can be accomplished by the provision of A paper cup provided with a heat conduction prevention plate, including: a cup body 4; and a heat conduction prevention plate 6, wherein a top of the cup body 4 is open and a bottom thereof is sealed to be capable of containing a drink therein, and the heat conduction prevention plate 6 is attached to be symmetrical to each of predetermined parts of an outer circumference surface of the cup body 4, is configured to be in close contact with the cup body 4 when not used and be spaced by a certain interval from the cup body 4 when used to prevent heat transmission from the cup body 4, and is provided to have an area that can be held with fingers to be capable of being manufactured at a low manufacturing cost, and a width of the heat conduction prevention plate increases toward a top thereof so that the heat conduction prevention plate 6 slips less from fingers.

Preferably, the heat conduction prevention plate 6 may include a plate body 7 which contacts with the palm or fingers and has a rectangular plate shape of being formed long in a vertical direction; an upper supporter 8 which is configured to extend from the top of the plate body 7 and on the top of which a first inserted part 12 is provided, wherein the first inserted part 12 is inserted, attached, and fixed to an upper edge, i.e., a curled portion, of the cup body 4; a lower support 22 provided with a third attachment part 26*b* and a second inserted part 26*a*, wherein the third attachment part 26*b* is attached to a lower part of the plate body 7, and the second inserted part 26*a* is inserted into a "¬"-shaped restricting part formed between a spacing support part 21 and the plate body 7; upper racks A formed on left and right sides of the upper supporter 8 of the plate body 7 and configured to support the plate body 7 to be spaced by a certain distance from the cup body 4; and a plurality of central racks B formed to be adjacent to each other in a longitudinal direction at a predetermined central portion of the plate body 7 and configured to support the plate body 7 to be spaced by a certain distance from the cup body 4.

Preferably, first cutaway portions 10 are formed between the upper racks A and the upper supporter 8, wherein the upper racks A include punched portions 14 for bending formed on a plurality of bending lines to be bent, and a first attachment part 16 is formed at the top of each of the upper racks A.

Preferably, the central racks B include second cutaway portions 18 extending from the plate body 7 and formed by cutting edge portions of the central racks B, except for the spacing support parts 21 provided to space the plate body 7 by a certain distance from the cup body 4, to facilitate bending; and second attachment parts 20 formed at upper parts of the central racks B.

Advantageous Effects

As apparent from the above description, in a paper cup provided with a heat conduction prevention plate according to the present invention, the paper cup is integrally provided with a heat conduction prevention plate, so that it is not necessary for a user to frequently insert a separate heat conduction prevention plate into the paper cup when drinking a drink. In addition, the heat conduction prevention plate is spaced by a certain interval from the cup body, thereby effectively preventing heat transmission even from a very hot drink. In addition, the heat conduction prevention plate itself has elasticity, it can prevent the paper cup from being slipped when grasped by a user. Further, upper and lower ends of the heat conduction prevention plate are provided with inserted parts, thereby preventing the heat conduction prevention plate from tilting upward or downward unnecessarily. Further, the heat conduction prevention plate is provided to have an area that can be held with fingers, thereby being capable of being manufactured at a low manufacturing cost. Moreover, since the width of the heat conduction prevention plate is configured to increase toward the top thereof, the heat conduction prevention plate slips less from fingers.

BEST MODE

Hereinafter, the present invention is described in detail with reference to the attached drawings.

Figure 1:
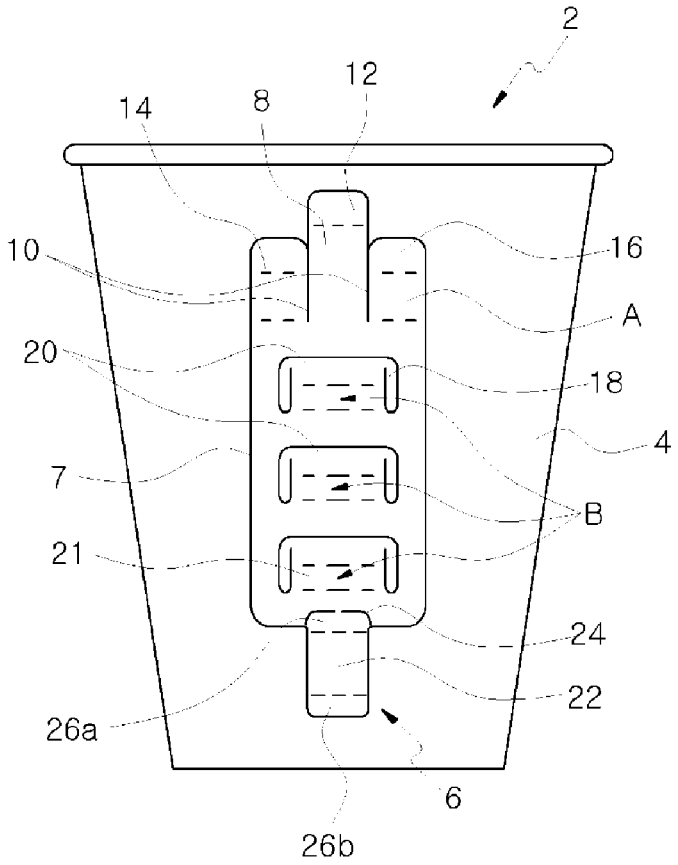
FIG. 1 is a plan view illustrating a heat conduction prevention plate according to an embodiment of the present invention.
Figure 2:
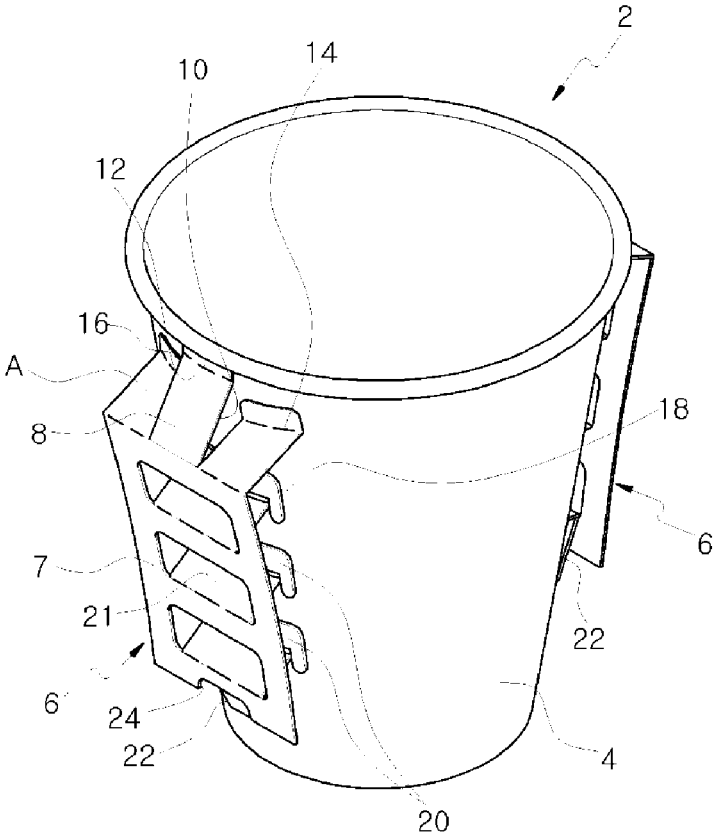
FIG. 2 is a perspective view illustrating a paper cup provided with a heat conduction prevention plate according to an embodiment of the present invention.
Figure 3:
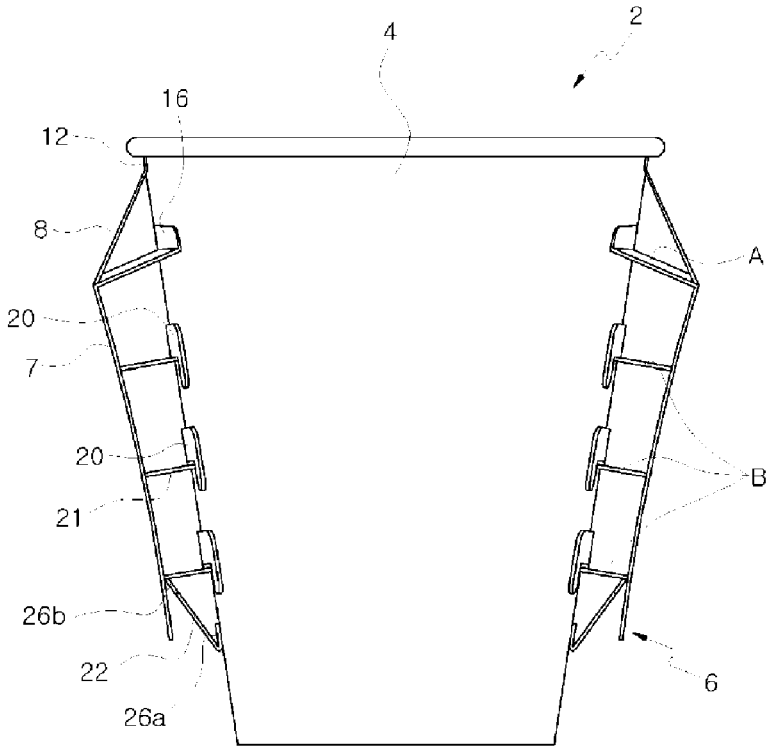
FIG. 3 is a front view illustrating a paper cup provided with a heat conduction prevention plate according to an embodiment of the present invention.
Figure 4:
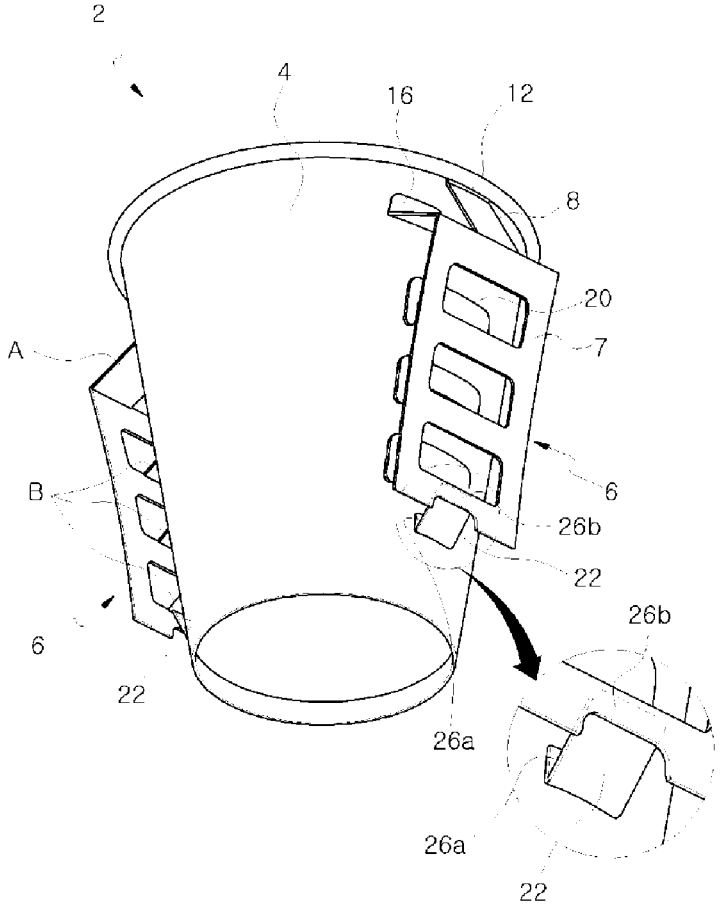
FIG. 4 is a perspective view illustrating a paper cup provided with a heat conduction prevention plate according to an embodiment of the present invention viewed from a different angle.

FIG. 1 is a plan view illustrating a heat conduction prevention plate according to an embodiment of the present invention, FIG. 2 is a perspective view illustrating a paper cup provided with a heat conduction prevention plate according to an embodiment of the present invention, FIG. 3 is a front view illustrating a paper cup provided with a heat conduction prevention plate according to an embodiment of the present invention, and FIG. 4 is a perspective view illustrating a paper cup provided with a heat conduction prevention plate according to an embodiment of the present invention viewed from a different angle.

Referring the attached drawings, in a paper cup provided with a heat conduction prevention plate according to an embodiment of the present invention, the paper cup is integrally provided with a heat conduction prevention plate, so that it is not necessary for a user to frequently insert a separate heat conduction prevention plate into the paper cup when drinking a drink. In addition, a certain space is formed between the integrated heat conduction prevention plate and the paper cup body, thereby effectively performing a heat conduction blocking function. Further, the heat conduction prevention plate is provided to have an area that that can be held with fingers, thus being manufactured at a low manufacturing cost. Moreover, the width of the heat conduction prevention plate increases toward the top thereof, so that the heat conduction prevention plate slips less from fingers.

A paper cup 2 provided with a heat conduction prevention plate according to an embodiment of the present invention has a cylindrical shape. More particularly, the paper cup 2 includes a cup body 4; and a heat conduction prevention plate 6, wherein the top of the cup body 4 is open and the bottom thereof is sealed to be capable of containing a drink therein, and the heat conduction prevention plate 6 is attached to be symmetrical to each of predetermined parts of an outer circumference surface of the cup body 4 and is configured to be spaced by a certain interval from the cup body 4 to prevent heat transmission from the cup body 4.

Here, the cup body 4 is a cylindrical member with an open top to accommodate a hot drink as well as a cold drink.

The heat conduction prevention plate 6 is a member for preventing heat or chill of a drink from being transmitted to the user's hand upon grasping the paper cup 2 containing a drink. The heat conduction prevention plate 6 may be made of, for example, paper, nonwoven fabric, corrugated paper, foamed synthetic resin, plastic, polypropylene, a polyethylene-coated material, or the like.

Here, upon use of the heat conduction prevention plate 6, the entire palm including the user's fingers is not necessary to grasp the paper cup 2. Accordingly, the heat conduction prevention plate 6 is preferably configured to have an area corresponding to essential parts contacting fingers when grasped with the fingers.

That is, as shown in the drawings, the heat conduction prevention plate 6 is a rectangular plate attached to predetermined parts of the cup body 4. A plurality of heat conduction prevention plates 6 are symmetrically attached to an outer circumference surface of the cup body 4.

Meanwhile, the heat conduction prevention plate 6 is attached to the cup body 4 not to be freely detached or separated therefrom. A known adhesive (not shown) having certain heat resistance and cold resistance is applied to predetermined parts of the heat conduction prevention plate 6 and the cup body 4, so that the heat conduction prevention plate 6 is attached to the cup body 4.

More particularly, the heat conduction prevention plate 6 is configured to have an area that can be held with fingers, thus being manufactured at a low manufacturing cost. In addition, the width of the heat conduction prevention plate 6 increases toward the top thereof, so that the heat conduction prevention plate 6 slips less from fingers.

Preferably, the heat conduction prevention plate 6 is constituted of a plate body 7 which contacts with the palm or fingers and has a rectangular plate shape that is long in a vertical direction; and an upper supporter 8 which is configured to extend from the top of the plate body 7 and on the top of which a first inserted part 12 for preventing the heat conduction prevention plate 6 from tilting upward or downward unnecessarily is provided, wherein the first inserted part 12 is inserted, attached, and fixed to an upper edge, i.e., a curled portion, of the cup body 4.

In addition, the heat conduction prevention plate 6 includes a lower support 22 provided with a third attachment part 26*b* and a second inserted part 26*a*, wherein the third attachment part 26*b* is formed at a lower part of the plate body 7 and attached to the cup body 4, and the second inserted part 26*a* is inserted into a restricting part formed between a spacing support part 21 and the plate body 7 to prevent the heat conduction prevention plate 6 from tilting downward unnecessarily; upper racks A formed on left and right sides of the upper supporter 8 of the plate body 7 and configured to support the plate body 7 to be spaced by a certain distance from the cup body 4; and a plurality of central racks B formed to be adjacent to each other in a longitudinal direction at a predetermined central portion of the plate body 7 and configured to support the plate body 7 to be spaced by a certain distance from the cup body 4.

That is, the heat conduction prevention plate 6 is manufactured with a sheet having a plan view as illustrated in FIG. 1. The upper supporter 8 of the sheet attached to predetermined positions of the cup body 4 is pulled upward and assembled using the thumb and index finger, thereby constituting the heat conduction prevention plate 6 spaced by a certain space from the cup body 4.

Meanwhile, first cutaway portions 10 are formed between the upper racks A and the upper supporter 8, the upper racks A include punched portions 14 for bending formed on a plurality of bending lines to be bent, and a first attachment part 16 is formed at the top of each of the upper racks A.

In addition, the central racks B are formed of second cutaway portions 18 extending from the plate body 7 and formed by cutting edge portions of the central racks B, except for the spacing support parts 21 provided to space the plate body 7 by a certain distance from the cup body 4, to facilitate bending; and second attachment parts 20 formed at upper parts of the central racks B.

Here, the first cutaway portions 10 are provided to cut boundaries between the upper supporter 8 and the upper racks A and are straight cutaway portions. The second cutaway portions 18 are cut in a shape of "⊏", and an internal area of each of the second cutaway portions 18 is positioned to be horizontal to the cup body 4 while extending from the plate body 7 to facilitate bending and cause the central racks B to maintain a state spaced by a certain interval.

Preferably, three central racks B are provided.

The third cutaway portion 24 serves to separate the lower support 22 from a plan view of the heat conduction prevention plate 6 made of a sheet. A predetermined central portion of the third cutaway portion 24 is a non-cutaway portion, not a cutaway portion.

In addition, the punched portions 14 for bending are formed at all of a plurality of positions having bending lines. The punched portions 14 are provided by punching the bending lines by a regular interval by means of a separate punching device (not shown), thereby facilitating bending.

Such bending portions are bent by repeatedly pressing by means of a straight press.

In addition, the first, second, and third attachment parts 16, 20, and 26*a* may be attached using an adhesive or using high-temperature, high-pressure PE bonding. A method of bonding the first, second, and third attachment parts 16, 20, and 26*a* may be arbitrarily selected from among a bonding method using an adhesive, a high-temperature, high-pressure bonding method, an ultrasonic bonding method, a high frequency bonding method, and a hot air bonding method.

The first inserted part 12 is provided at the top of the upper supporter 8 and is inserted into or fixed to an upper edge, i.e., a curled portion, of the cup body 4.

The second inserted part 26*a* is provided at the top of the lower support 22. More particularly, the second inserted part 26*a* is inserted into a "¬"-shaped restricting part formed between the spacing support part 21 and the plate body 7, thereby elastically supporting a lower part of the plate body 7.

Hereinafter, the functions and operation of the paper cup provided with a heat conduction prevention plate according to an embodiment of the present invention described above are described with reference to the accompanying drawings.

First, with regard to the paper cup 2 provided with a heat conduction prevention plate according to an embodiment of the present invention, the first, second, and third cutaway portions 10, 18, and 24 of a sheet having the plan view illustrated in FIG. 1 are cut, and then the first and second attachment parts 16 and 20 are attached to the cup body 4. In this state, the lower support 22 partially attached to the plate body 7 is separated from the plate body 7 due to the third cutaway portion 24 when the upper supporter 8 is pulled upward using the thumb and index finger.

In particular, the third attachment part 26*b* is attached to a lower part of the cup body 4, and the second inserted part 26*a* causes an upper part of the lower support to be inserted into a "¬"-shaped restricting part between the spacing support part 21 and the plate body 7. Accordingly, the second inserted part 26*a* is located between the spacing support part 21 and the plate body 7, and the first inserted part 12 is maximally inserted into a gap of a reinforcing rim, i.e., a curled portion, formed at the top of the cup body 4 to be fixed.

When a user presses the plate body 7, the plate body 7 exhibits elastic force, and the second inserted part 26*a* is not separated from the spacing support parts 21 and the plate body 7.

In a completely assembled state, when a user grasps the heat conduction prevention plate 6 symmetrically attached to an outer circumference surface of the paper cup 2 so as to use the paper cup 2 provided with a heat conduction prevention plate according to an embodiment of the present invention, the thumb is in close contact with the heat conduction prevention plate 6 spaced by a certain distance from the cup body 4, and some or all of the remaining four fingers are in close contact with another heat conduction prevention plate 6 attached to an opposite side.

Here, although the heat conduction prevention plate 6 is spaced by a certain interval from the cup body 4, the heat conduction prevention plate 6 is in close contact with user's fingers and a central portion of the heat conduction prevention plate 6 is bent toward the cup body 4 due to elastic force thereof when the heat conduction prevention plate 6 is grasped with the user's hand or fingers.

Accordingly, the heat conduction prevention plate 6 does not easily slip from the user's fingers or hand.

In addition, since the heat conduction prevention plate 6 is attached to the cup body 4, there is no need to separately prepare a holder for each use of a paper cup as in the case of existing holders (annular heat conduction prevention rings).

In addition, the heat conduction prevention plate of the present invention is provided to have an area that can be held with fingers, thereby being manufactured at a low manufacturing cost. Further, since the width of the heat conduction prevention plate is configured to increase toward the top thereof, the heat conduction prevention plate slips less from the fingers.

Meanwhile, the paper cup provided with a heat conduction prevention plate according to an embodiment of the present invention is not limited to the aforementioned embodiment and may be variously changed within the scope of not departing from the technical spirit of the present invention.

DESCRIPTION OF SYMBOLS

4: cup body 6: heat conduction prevention plate
7: plate body 8: upper supporter
22: lower support A: upper rack,
B: central rack

The invention claimed is:

1. A paper cup provided with a heat conduction prevention plate, comprising:

a cup body; and a heat conduction prevention plate, wherein:

a top of the cup body is open and a bottom thereof is sealed to be capable of containing a drink therein, the heat conduction prevention plate is attached to be symmetrical to each of predetermined parts of an outer circumference surface of the cup body, is configured to be spaced by a certain interval from the cup body to prevent heat transmission from the cup body, and is provided to have an area that can be held with fingers to be capable of being manufactured at a low manufacturing cost, and a width of the heat conduction prevention plate increases toward a top thereof so that the heat conduction prevention plate slips less from fingers, the heat conduction prevention plate comprises:

a plurality of central racks formed to be adjacent to each other in a longitudinal direction at a predetermined central portion of the plate body and configured to support the plate body to be spaced by a certain distance from the cup body, and the central racks comprise:

second cutaway portions extending from the plate body and formed by cutting edge portions of the central racks, except for spacing support parts provided to space the central racks by a certain distance from the cup body, to facilitate bending; and second attachment parts formed at upper parts of the central racks.

2. The paper cup according to claim 1, wherein the heat conduction prevention plate further comprises:

a plate body which contacts with the palm or fingers and has a rectangular plate shape of being formed long in a vertical direction;

an upper supporter which is configured to extend from the top of the plate body and on the top of which a first inserted part for preventing the heat conduction prevention plate from tilting upward or downward unnecessarily is provided, wherein the first inserted part is inserted, attached, and fixed to an upper edge, i.e., a curled portion, of the cup body;

a lower support provided with a third attachment part and a second inserted part, wherein the third attachment part is formed at a lower part of the plate body and attached to the cup body, and the second inserted part is inserted into a restricting part formed between a spacing support part and the plate body to prevent the heat conduction prevention plate from tilting downward unnecessarily; and upper racks formed on left and right sides of the upper supporter of the plate body and configured to support the plate body to be spaced by a certain distance from the cup body.

3. The paper cup according to claim 2, wherein first cutaway portions are formed between the upper racks and the upper supporter, wherein the upper racks comprise punched portions for bending formed on a plurality of bending lines to be bent, and a first attachment part is formed at the top of each of the upper racks.

* * * * *